United States Patent [19]

Winer

[11] Patent Number: 4,494,756

[45] Date of Patent: Jan. 22, 1985

[54] CUBE PUZZLE

[75] Inventor: Gordon E. Winer, Barnard, Vt.

[73] Assignee: Vermont Toy Works, Inc., Rutland, Vt.

[21] Appl. No.: 554,999

[22] Filed: Nov. 25, 1983

Related U.S. Application Data

[63] Continuation-in-part of Ser. No. 333,712, Dec. 23, 1981, abandoned.

[51] Int. Cl.[3] ..... A63F 9/12

[52] U.S. Cl. ..... 273/156

[58] Field of Search ..... 273/153 R, 156, 157 R

[56] References Cited

U.S. PATENT DOCUMENTS

| | | | |
|---|---|---|---|
| 284,037 | 8/1883 | McCleary | 273/156 |
| 487,063 | 11/1892 | Bailey | 273/156 |
| 490,689 | 1/1893 | Thurston | 273/156 |
| 1,568,576 | 1/1926 | Stout | 273/156 X |
| 3,771,795 | 11/1973 | Flanigen | 273/157 R |
| 4,216,964 | 8/1980 | Gans | 273/156 |

FOREIGN PATENT DOCUMENTS

| | | | |
|---|---|---|---|
| 173588 | 12/1921 | United Kingdom | 273/294 |
| 308886 | 4/1929 | United Kingdom | 273/156 |

*Primary Examiner*—Anton O. Oechsle

*Attorney, Agent, or Firm*—Lerner, David, Littenberg, Krumholz & Mentlik

[57] ABSTRACT

A cube puzzle is provided utilizing a group of 27 smaller cubes which are adapted to be assembled into a larger cube having a 3 by 3 by 3 configuration. The 27 cubes have at least first and second different sets of identifying indicia on each face thereof. The first set of identifying indicia include up to nine different numbers, some of which may be duplicated on different faces of any one cube and which are also oriented differently on different faces. A preferred embodiment of the assembled cube utilizes the numbers one to nine for the first set of indicia. The second set of identifying indicia include up to six different colors which also may be duplicated on different faces of the same cube. The cube puzzle also includes a transparent case having at least one removable face which may be used not only to package the puzzle but also for its assembly. A wide variety of different puzzle solutions in the assembly of the smaller cubes into the larger cube are possible based upon the numbers on the exposed faces of the smaller cubes satisfying predetermined arithmetic relationships and/or the color indicia satisfying different predetermined relationships or patterns of the colors. For example, the smaller cubes can be assembled into a larger cube so that the numbers on each surface of the larger cube are arranged in ascending or descending order and with each face being of one color, or so that the sum of the numbers is a predetermined value.

18 Claims, 32 Drawing Figures

Fig. 3.
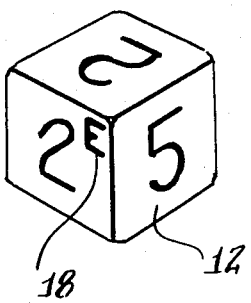
Fig. 4.
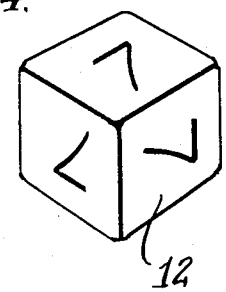
Fig. 5.
| | | | | | |
|---|---|---|---|---|---|
| 1C | 1 | 1 | 3 | 5 | 9 |
| 1 | 1 | 2 | 3 | 5 | 8J |
| 1 | 2U | 2 | 3 | 5 | 9 |
| 1 | 2 | 5 | 6 | 6 | 9Q |
| 1 | 2 | 3AA | 4 | 5 | 7 |
| 1 | 2 | 3 | 5K | 7 | 8 |
| 1 | 2L | 3 | 4 | 5 | 6 |
| 1 | 2 | 5 | 7X | 8 | 9 |
| 1 | 1 | 3 | 3 | 4Z | 6 |
| 1 | 3 | 3 | 4I | 6 | 9 |
| 1 | 3 | 3 | 5 | 6 | 6W |
| 1A | 3 | 5 | 7 | 9 | 9 |
| 1 | 3 | 7 | 7 | 9 | 9Y |
| | | | | | |
|---|---|---|---|---|---|
| 1 | 2 | 5 | 6 | 7 | 9N |
| 1 | 7 | 9 | 9 | 9 | 9S |
| 2 | 2 | 4 | 8 | 8F | 9 |
| 2E | 2 | 5 | 7 | 7 | 7 |
| 2G | 3 | 7 | 7 | 7 | 9 |
| 2 | 4O | 5 | 6 | 8 | 8 |
| 2 | 5 | 6 | 7 | 7R | 9 |
| 3 | 4M | 4 | 5 | 6 | 8 |
| 4 | 4 | 5 | 6 | 6 | 8T |
| 3B | 4 | 4 | 4 | 6 | 9 |
| 4 | 4 | 6 | 6H | 7 | 8 |
| 1 | 4 | 6 | 8 | 8 | 8D |
| 5 | 6 | 7 | 8 | 9 | 9V |
| 5 | 5 | 8 | 8 | 8 | 8P |

Fig. 6A.
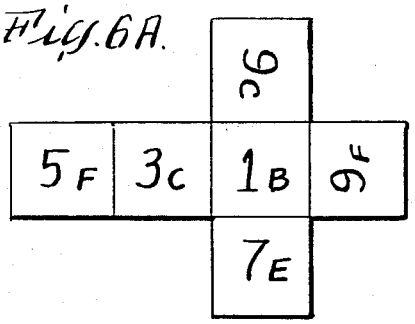
Fig. 6B.
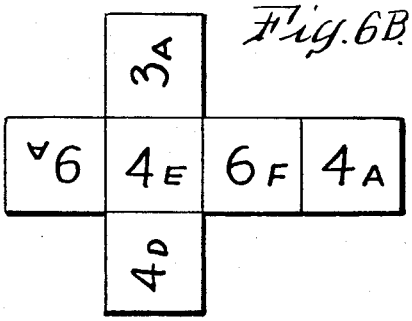
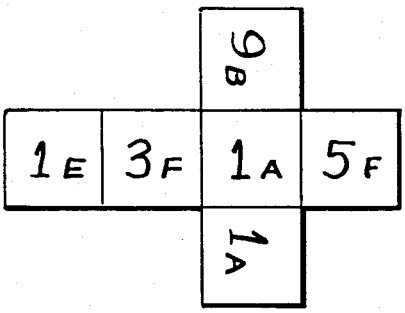
Fig. 6C.
Fig. 6D.
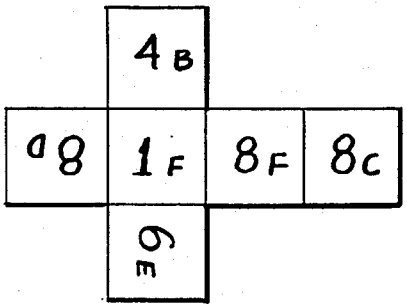
Fig. 6E.
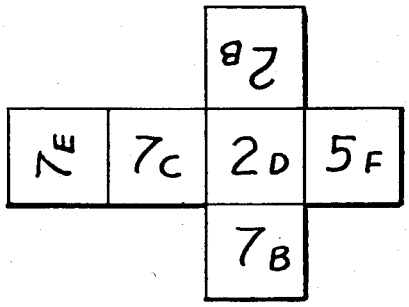
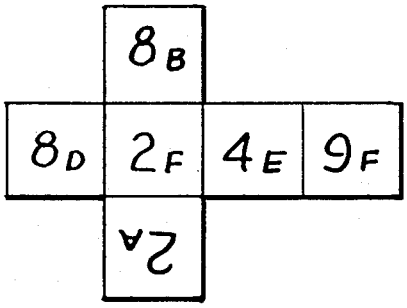
Fig. 6F.
Fig. 6G.
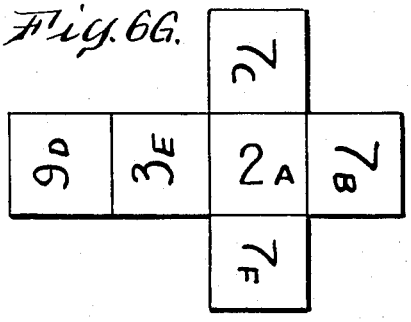
Fig. 6H.
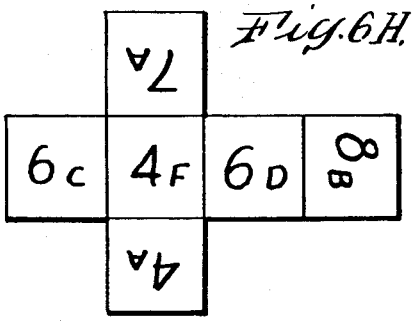
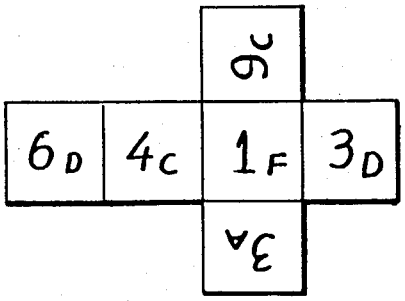
Fig. 6I.

Fig. 6J.
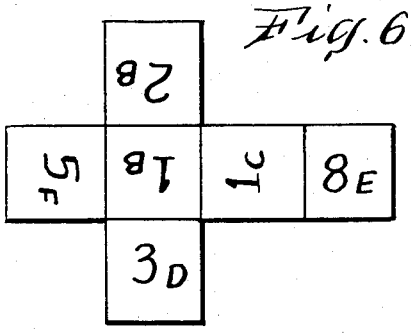
Fig. 6K.
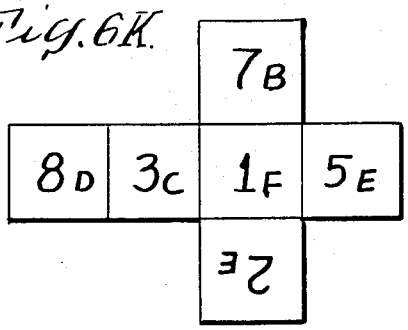
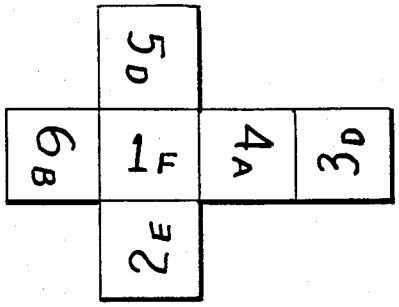
Fig. 6L.
Fig. 6M.
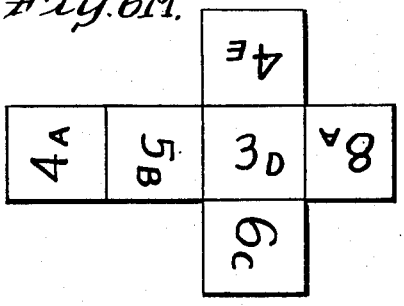
Fig. 6N.
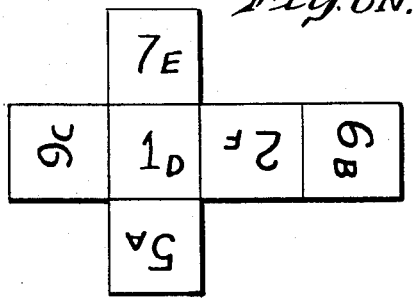
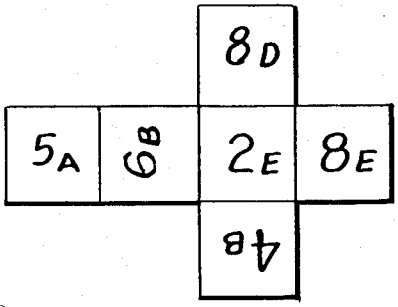
Fig. 6O.
Fig. 6P.
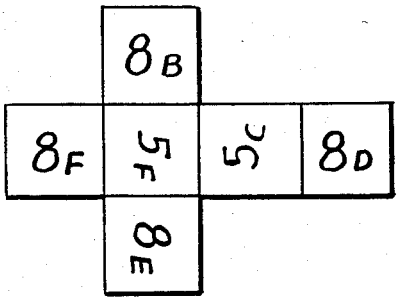
Fig. 6Q.
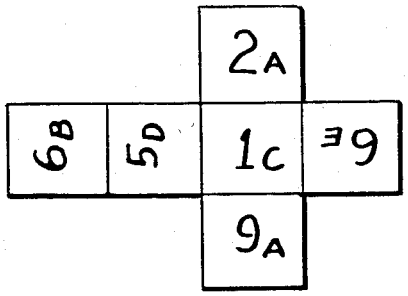
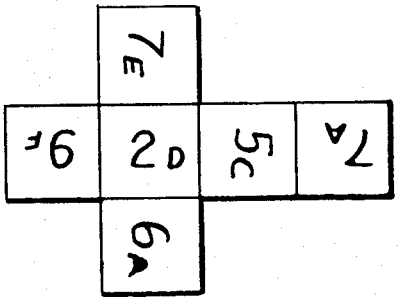
Fig. 6R.

Fig. 6S.
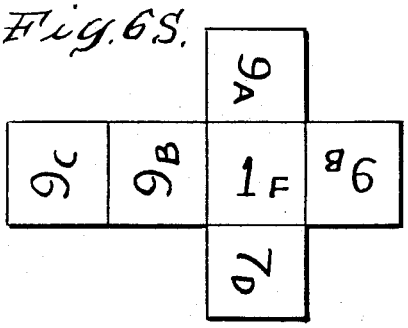
Fig. 6T.
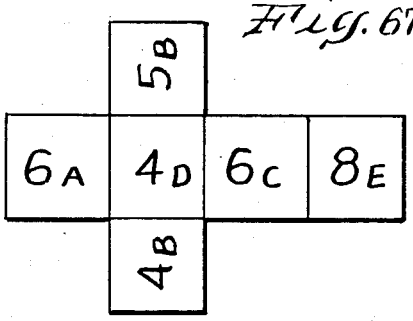
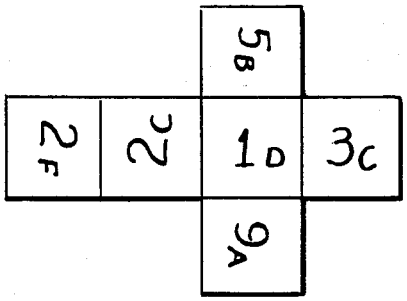
Fig. 6U.
Fig. 6V.
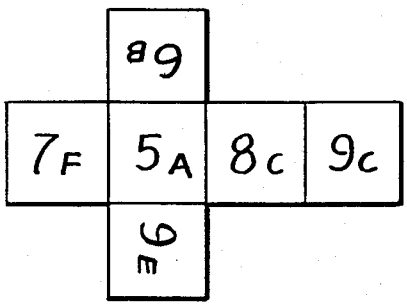
Fig. 6W.
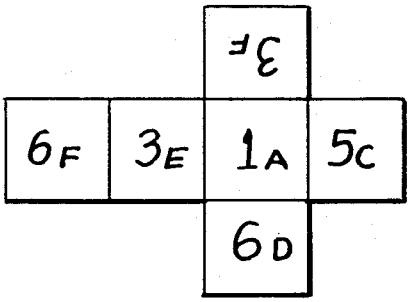
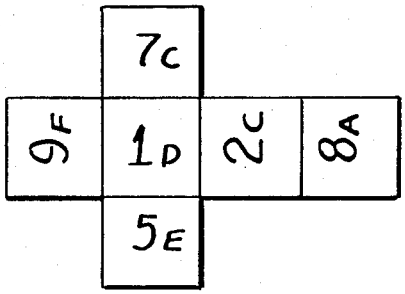
Fig. 6X.
Fig. 6Y.
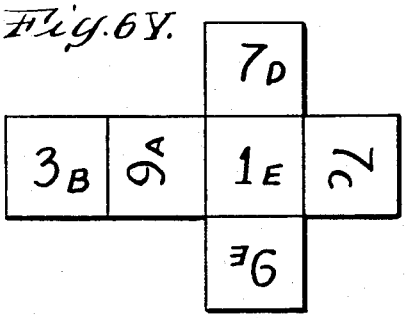
Fig. 6Z.
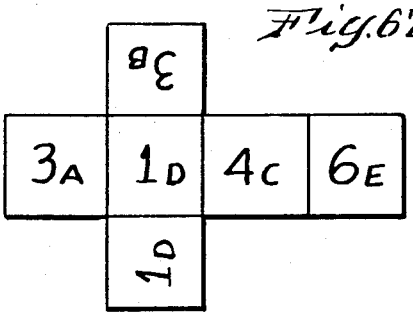
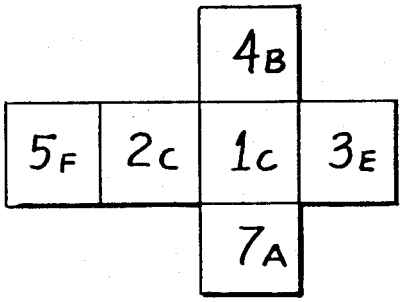
Fig. 6AA.

CUBE PUZZLE

CROSS REFERENCE TO RELATED APPLICATIONS

This is a continuation-in-part of application Ser. No. 333,712, filed Dec. 23, 1981, abandoned.

FIELD OF THE INVENTION

The present invention relates to manipulative type puzzles involving manipulation or movement of a number of puzzle pieces, and more particularly to a three dimensional cube puzzle in which a plurality of smaller cubes are assembled into a larger cube with the indicia on the faces of the individual cubes satisfying predetermined relationships. While in accordance with the preferred embodiment, the number of smaller cubes is 27 which are to be assembled into a larger cube having a 3 by 3 by 3 configuration, larger cubes made from different numbers of smaller cubes are also contemplated, such as for example cubic arrays of 64 individual cubes arranged in a 4 by 4 by 4 configuration or of 8 cubes arranged in a 2 by 2 by 2 configuration.

BACKGROUND OF THE INVENTION

Over the years, various types of puzzles and games have been developed for the purpose of providing amusement and entertainment, and in particular, a simple change of pace or escape from the everyday tasks, routines, and problems at hand, as well as providing different and often more interesting challenges of a less serious, but nontheless, more intriguing nature. One popular type of amusement device has been the manipulative puzzle in which various puzzle pieces are manipulated or moved about to solve or make a particular solution or object. Many of these manipulative type of puzzles have become so popular that they might even be considered contagious.

One such famous puzzle is the "15" puzzle first introduced in the 19th century, which comprises a two dimensional problem of restoring scrambled numbered pieces provided in a 4 by 4 square to their proper positions, such as in ascending or descending order. One of the latest and most recent crazes, known as the Rubik's Cube, involves a three dimensional cube puzzle which is manipulated in a manner to restore scrambled colored pieces of a 3 by 3 by 3 cube to their original or desired positions in which each face of the large cube is colored uniformly. As the individual cube segments are tied or interlocked together, the manipulations involve movement of nine cube segments at a time by rotation of a face or layer of the larger cube about its center. The solutions of either of these above types of puzzles require repeated backtracking or temporary destruction of a portion already completed in order to move on and make progress towards the ultimate solution.

Such well known and popular manipulative puzzles have provided many hours of enjoyment and entertainment to individuals, as the solutions or manners of manipulation to reach the ultimate solution are not always readily apparent, but instead require planning and foresight.

While the above-noted manipulative puzzles are two of the more well known, a large variety of other manipulative puzzles have also been developed or contemplated, some of which are discussed more fully hereinbelow. In this regard, it should be noted that with many of the manipulative types of puzzles or games which have been developed over the years, only a single or a very limited number of solutions are possible. For instance, in the Rubik's Cube type puzzle, the basic solution comprises having each of the faces of the large cube comprised of a single color, with a different colors being provided on each of the six faces. While other solutions are possible involving different patterns of the various colored subcubes, these simply involve variations on the common theme. Undoubtedly, one of the reasons for the great popularity of these types of puzzles involve the fact that, while there is only a single or limited number of solutions, the manner of reaching such solutions are virtually unlimited since the various solutions require repeated backtracking and temporary destruction of already completed portions. This is for the reason that movement of one or several of the pieces are tied together so that there are only a limited number of manners of moving the various pieces. In other words, the individual pieces are not truly individual in the sense that one can be moved and simply substituted for another; rather, movement of several pieces is required to simply change the position of a desired piece.

Other manipulative puzzles are known which are comprised of a plurality of truly individual pieces or components in which movement or reorientation of an individual piece can be accomplished without movement of each of the remaining pieces. For instance, U.S. Pat. No. 3,771,795 discloses a three dimensional cube type puzzle comprised of 27 individual blocks having different colors on each of their faces. The individual cubes can then be assembled in a variety of different manners to provide a variety of different solutions, such as for example each surface of the overall large cube being of a single color, or so that particular patterns of contrasting colors are provided. This patent also discloses a stand in the form of a three sided support of sheet plastic which may also serve as a package for holding the individual blocks together during shipment and during solving of particular solutions. This patent further discloses that larger cubes comprised of greater numbers of blocks could be utilized, such as for example 64 blocks arranged in a 4 by 4 by 4 array, or 125 individual blocks or cubes arranged in a 5 by 5 by 5 array. It is also to be noted that when the large cube is assembled from 27 blocks, the number of different colors utilized is three, whereas in puzzles constructed from 64 blocks, four different colors are provided on the individual faces of the various cubes and in 125 block puzzles, five different colors are utilized. While a number of different solutions are provided in the puzzle disclosed in this patent, it will be appreciated that the number of solutions is nevertheless limited since only a very few different colors are provided. Indeed, for a 27 block puzzle, this patent teaches that only 10 different blocks are used. Furthermore, each of the different solutions which are possible are based upon the concept of matching and/or contrasting different colors to provide particular patterns in the ultimate solutions, and therefore simply involve variations of a single theme.

British Patent Specification No. 308,886 also discloses a three dimensional cube type puzzle comprised of a plurality of individual cubes in which the individual faces are colored with different colors and are also provided with letters or parts of words. The object in accordance with this reference is to construct a large cube to display messages, pictures or other objects thereon together with a contrasting color scheme in which each surface of the constructed cube displays each of the six different colors provided on the six faces of the individual cubes. It is to be appreciated that with the types of cube pieces disclosed in this reference, there is a definite predetermined relationship which must be maintained between the individual cubes when they are assembled into the larger cube in order to provide any meaningful message, picture or other object which is to be portrayed. This is due to the nature of the use of letters or combinations of letters, and the manner in which one deals with same in his language. Consequently, in aligning the individual pieces together in a certain array, a certain order between sets of letters must be maintained or one will have the feeling that the "solution" is out of order. This built-in prejudice which results from dealing with a language is one which is easily overlooked, and, as can be appreciated, is self-limiting in permitting a large variety of different solutions or arrays. Indeed, this fact that only one or a very limited number of solutions are possible is undoubtedly the reason that extra cubes are provided in the puzzle of this reference, i.e., so that several solutions can be provided.

Various types of two dimensional puzzles or games are also known in the art. For example, U.S. Pat. No. 4,216,964 discloses a two dimensional puzzle game which includes a plurality of blocks and a playing board. This reference teaches a game or puzzle wherein the blocks are placed in square arrays (i.e., having the same number of rows and columns). Numbers are provided on the faces of the individual blocks or cubes, and the game is played by placing the various blocks in different positions on the playing board so that the sum of the numbers appearing on the faces in each row and in each column and along the diagonals equals the same number. For example, in a 3 by 3 array in which nine blocks are provided having the numbers one through nine thereon, the solution contemplated in accordance with this reference is one in which the sum of the numbers appearing on the top faces of the blocks will add up to fifteen in each row, each column and along the diagonals. Consequently, it will be appreciated that in accordance with this patent, there is essentially only a single solution for satisfying the desired relationship, it being realized that the mirror images of a particular array would also satisfy the same criteria. Accordingly, once the particular solution is learned by an individual, there is no longer any challenge to solving this puzzle. In order to provide a number of different puzzles having different solutions, the playing board is designed to accommodate a number of larger size square arrays (i.e., up to nine rows and columns). Also, this patent teaches that different sets of numbers on the blocks can be used to provide sufficient solutions, although the basic concept of the rows and columns adding to the same number remains the same.

Another two dimensional type puzzle is shown in U.S. Pat. No. 490,689 which discloses a two dimensional puzzle played with a playing board or box and individual tablets each of which contain a plurality of numerical indicia and a plurality of color indicia thereon. The various tablets are assembled within the box so that the number and color indicia appearing along each edge or quadrant of the tablets will match a corresponding set of indicia on the adjacent tablet. Thus, this reference simply teaches a matching type game in which no arithmetic solutions are provided, the numbers and colors simply serving as objects to be matched. A somewhat similar puzzle which also teaches a matching type solution is shown in British Patent Specification No. 173,588.

Thus, it will be appreciated that with respect to each of the above-described puzzles, there is essentially only a limited number of solutions which are possible. Consequently, when individuals learn these limited number of solutions, the puzzle will no longer serve to entertain and amuse, or at least not to the same extent that it previously did. Furthermore, it is to be noted that even to the extent that different puzzle solutions may be provided in the puzzles of the prior art, particularly those described above, their various solutions are essentially minor variations of the same theme so that there is no different degree or level of challenge provided by the different solutions.

SUMMARY OF THE INVENTION

There is provided in accordance with the present invention a three dimensional cube puzzle which is interesting and challenging and lends itself to a wide variety of different puzzle solutions of different and varying levels of challenge. More particularly, the three dimensional cube puzzle in accordance with the present invention comprises, in one form, 27 individual cube pieces each having six exposed faces and having numerical indicia means provided on each face thereof. The numerical indicia means are representative of a number selected from a group of nine different numbers, and each face of each of the cube pieces has one of the numerical indicia means thereon to define a set of six numerical indicia for each cube piece. Substantially all of the sets of six numerical indicia are different, and consist from two to six different numbers. Support means are also provided for holding and displaying a cubic array of the 27 cube pieces assembled to provide a 3 by 3 by 3 configuration. The cubic array has six exposed surfaces each of which is comprised of nine assembled faces of the cube pieces in a 3 by 3 configuration. The support means is adapted to maintain the 27 assembled cube pieces in the cubic array and to permit visual inspection of each of the six exposed surfaces of the cubic array. The numerical indicia means for the cube pieces are selected to provide at least ten different cubic arrays in which, on each of the six exposed surfaces of each such cubic array, the numerical indicia means on the nine assembled faces of the individual cube pieces satisfy a predetermined arithmetic relationship between the numerical indicia means.

The use of numerical indicia means which are selected so as to satisfy a predetermined arithmetic relationship is a key feature of the present invention as it is the use of such numerical indicia means which permits a wide variety and multitude of different puzzle solutions of varying levels of challenge. Examples of typical arithmetical relationships which the numerical indicia means can satisfy include arithmetic progressions, both ascending and descending, the sum of the various numbers on the exposed surfaces of the cubic array being a particular number (such as a prime number, a square of a number, or a cube of a number) and odd or even number patterns for the exposed surfaces of the cubic array. In this regard, the above examples simply comprise some of the types of arithmetic relationships which may be satisfied, and should not be deemed to be limiting in terms of the types or numbers of relationships which are or can be satisfied.

The use of an arithmetic relationship is most important in terms of providing a multitude of different solutions since there is no built-in prejudice in society with respect to maintaining particular orders of numbers. Indeed, the norm in real life is that numbers have no particular order, such as for example a two always following a one and being followed by a three. One need only take a look at the prices charged for various products and realize that it is unusual that a particular price may be $123 or $4.56. While certainly in some instances a desired order of numbers is important, this simply is not the norm in all instances such as traditionally and normally exists with respect to orders and arrangements of alphabetic characters or letters which can only be combined in certain manners to form particular words. While the 26 letters of the English alphabet are combinable in a great multitude of manners, when one is working with a cube type puzzle having a limited number of individual cubes, the use of letters are self-limiting if ordered arrays thereof are to be provided on each of the six exposed faces. No such self-limiting factor exists with respect to numbers as numbers may be combined in truly an infinite number of ways. Consequently, the use of numerical indicia on the exposed faces of individual cubes is distinctly different in kind from the use of letters or combinations of letters in terms of the variety of solutions which can be satisfied for arrangements of cubic arrays of individual cube pieces.

The principles of the present invention in terms of the utilization of numerical indica on the individual faces of cube pieces can also be applied with respect to other cubic arrays composed of a different number of cube pieces. For instance, eight cubes can be combined or arranged in a cubic array having a 2 by 2 by 2 configuration, and 64 cubes arranged or combined in a cubic array having a 4 by 4 by 4 configuration. In these instances, the numerical indicia means would be representative of a number selected from a group of four or sixteen different numbers, respectively. Of course, it will also be appreciated that still further cubic arrays composed of different numbers of individual cube pieces could be provided, the number of individual cube pieces being $n^3$, and the numerical indicia means being representative of a number selected from a group of $n^2$ different numbers, where "n" is an integer greater than one. The assembled cubic arrays would then have an n by n by n configuration with the six exposed surfaces each comprised of $n^2$ assembled faces of cube pieces in an n by n configuration.

In accordance with a preferred embodiment of the present invention, color indicia means are also provided on each face of the individual cube pieces with the color indicia means being representative of a color selected from a group of six different and distinguishable colors and with each face of each of the cube pieces having one of the color indicia means thereon to define a set of six color indicia for each cube piece. The color indicia chosen for the various faces may be duplicated on each individual cube. The use of a color indicia means on the individual faces serves to provide an additional variable so that still further puzzle solutions, varied in form and offering various levels of challenge, can be provided based on satisfying different color relationships. For example, the numerical and color indicia means for the cube pieces can be selected to satisfy predetermined arithmetic relationships and/or color relationships between the various indicia means.

Still further in accordance with the preferred embodiment, the support means comprises a transparent cube-shaped container having at least one openable side through which the cubes may be placed into the interior and assembled into the cubic array.

In a still further preferred embodiment, the numerical indicia means comprise arabic numbers which enhances the number and variety of solutions by introducing an orientation feature. When the arabic numbers are provided on the various faces of the cubes, it will be appreciated that there is from one to four different orientations for each number. Consequently, by providing an orientation feature, further varieties and levels of challenge may be provided by requiring that the orientations of the numerical indicia be in a desired or particular oder. Instead of arabic numbers, the numerical indicia means could also comprise dots or other objects, the quantity of which is representative of the number appearing on the face of the cubes.

These and further features and characteristics of the present invention will be apparent from the following detailed description in which reference is made to the enclosed drawings which illustrate a preferred embodiment of the present invention.

BRIEF DESCRIPTION OF THE DRAWINGS

FIG. 3 is a perspective view of one of the 27 cubes of the cube puzzle illustrated in FIGS. 1 and 2, illustrating one type of orientation of the numerical indicia means as well as an alphabetic solution code or key which may be employed on each of the cubes.

FIG. 4 illustrates the three faces of the cube shown in FIG. 3 which are not visible in that figure.

FIG. 5 is a table illustrating the numerical indicia means on the six faces of each of the 27 cubes as well as an alphabetic code or key symbol which may be used with proper instructions for specifying a variety of solutions for the puzzle in accordance with the present invention.

FIGS. 6A–AA illustrate one orientation and identifying indicia arrangement on all the faces of the 27 cubes, with the letters A–F used to designate different colors while the letters of the Figures indicate the code or key designations.

DESCRIPTION OF THE PREFERRED EMBODIMENTS

Figure 1:
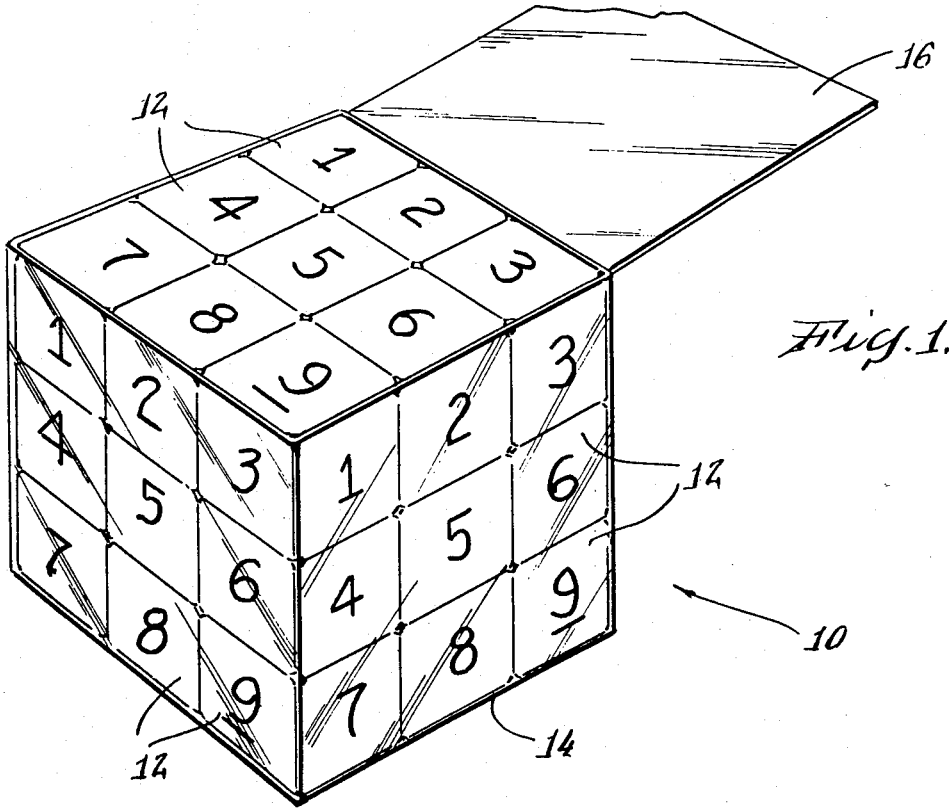
FIG. 1 is an isometric view of the cube puzzle embodying the present invention assembled in a transparent case illustrating one possible solution to the puzzle.
Figure 2:
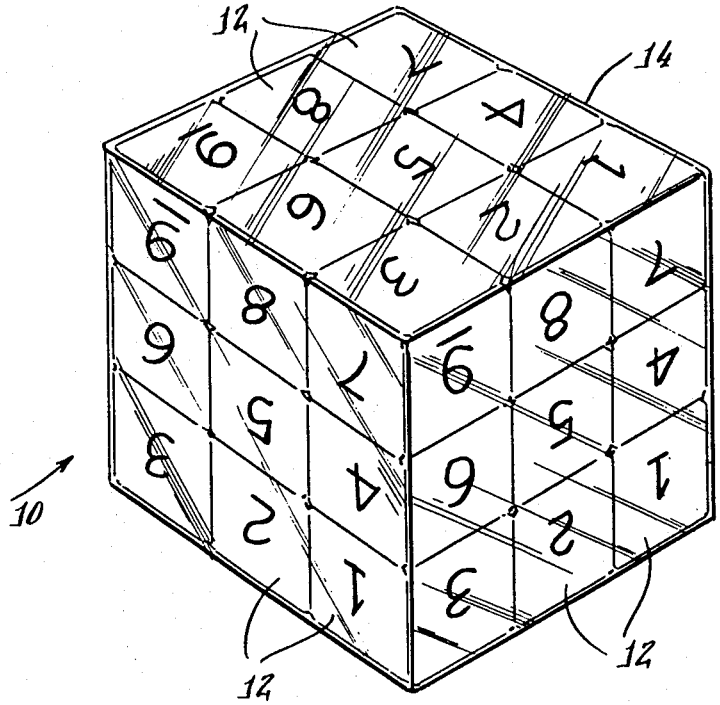
FIG. 2 is a perspective view of the assembled cube puzzle illustrated in FIG. 1, showing the three faces of the assembled cube which are not visible in FIG. 1.

Referring now to FIGS. 1 and 2, an assembled large cubic array, referred to generally with the reference character 10, is assembled utilizing 27 individual smaller cube pieces 12, one of which is illustrated in FIGS. 3 and 4. The cube pieces 12 are housed in a cube shaped transparent case, frame or container 14 having at least one removable or opening side 16 thereon. The case, for example, may be made of a transparent plastic such as acrylic sheet, polycarbonate, etc. The case 14 is useful for packaging the individual cube pieces 12 as well as for assembling the cube pieces 12 into the larger cube or cubic array 10 for the puzzle solution. The removable or opening side 16 may be hinged, frictionally engaging having a tongue and groove, or of an interlocking configuration, an example of the latter being two inverted U-shaped elements which when separated open one or more of the sides and make the interior of the container 14 accessible for aligning and stacking the individual cube pieces 12 in the container 14. It would be advantageous to have more than one of the sides capable of opening or being removed when the larger cube 10 is assembled because solutions to the puzzle will usually require partial or temporary destruction to the arrangement in order to continue to progress to a solution.

The individual cube pieces 12 in accordance with the preferred embodiment of the present invention are assembled into the larger cubic array 10 by making a 3 by 3 by 3 configuration. The cube pieces 12 preferably each have first, second and third sets of identifying indicia positioned thereon. At least one of the identifying indicia comprises a numerical indicia means which is representative of a number. For instance, the numerical identifying indicia may comprise an arabic character as in the embodiment illustrated in the drawings, or it may comprise one or more dots or other symbols, the quantity of which represents a number. The other identifying indicia may be letters, symbols, colors or any type of identifying marks which are readily and preferable physically distinguishable to the user.

As illustrated in the drawings, the first set of identifying indicia comprising the numerical indicia means are the arabic characters representing the numbers one through nine which are applied to the six faces of the individual cubes and which may be duplicated on individual faces of the various cubes. As illustrated in FIGS. 3 and 4, the number "7" is duplicated three times, and the number "2" is duplicated twice, while the remaining face has the number "5" thereon. It will thus be appreciated that the six faces of the individual cube pieces 12 having the numerical indicia means thereon will thus define a set of six numerical indicia. For the particular example shown in FIGS. 3 and 4, the set of six numerical indicia is "2-2-5-7-7-7".

FIG. 5 of the drawings illustrates a table or chart of the sets of six numerical indicia for each of the 27 cube pieces 12 of the preferred embodiment. It will be appreciated from FIG. 5 that each cube piece 12 has from two to six different numbers on its six faces. It will also be appreciated that in the preferred embodiment, each of the sets of six numerical indicia are different from one another.

It will further be appreciated that since one of the cube pieces 12 will be assembled in the center of the larger cubic array 10, and will not be visible from any of the six exposed surfaces, it is not required to have any identifying indicia thereon. In this case, the puzzle solver would have a key to the position of one cube, namely the center most cube of the larger cube 10. Further, it will be appreciated that in certain puzzles and solutions, the center cube piece will not necessarily be the center cube piece in another puzzle solution. Therefore, it is preferable to provide identifying indicia on all of the cubes which makes the solving of various solutions even more difficult.

The second set of identifying indicia provided on the faces of the individual cube pieces 12 in the preferred embodiment comprises a color indicia means which is representative of a particular color. More particularly, in the preferred embodiment illustrated in the drawings, the color indicia means is representative of a group of six different distinguishable colors which may appear on the six different faces of each cube, or may be duplicated so that only two to five different colors appear on the faces of any one cube. The colors may be applied to the entire face of each cube, or, in accordance with the preferred embodiment, the symbols of the numerical identifying indicia may be applied to the faces of the cube pieces 12 in the colors forming the second set of identifying indicia. For example, as illustrated in the drawings of FIGS. 1 and 2, the first set of identifying indicia, i.e., the arabic numbers or characters one through nine, are printed in the colors of the second set of identifying indicia.

The third set of identifying indicia 18 provided in the preferred embodiment comprise alphabetic characters. For instance, in FIG. 3 the letter "E" is illustrated on one of the faces of the cube piece 12. As will be noted in FIG. 5, each of the 27 cubes is lettered from "A" through "Z" and "AA" on one of the faces of the cube pieces 12. These identifying indicia 18 may be utilized in identifying the specific different cube pieces 12 so that a particular solution of the puzzle may be provided by simply identifying prescribed positions for the individual cube pieces 12 in the larger assembled cube 10. Various solutions for different cubic arrays for the larger cube 10 may thus by simply given or illustrated by identifying the position of each particular cube piece 12 in the overall large cubic array 10, i.e., which one of the 27 possible positions each of the individual cube pieces 12 is to be placed.

Another variable within the cube pieces 12 is the orientation of the numerical identifying indicia means or first set of identifying indicia—namely the arabic numbers one through nine. This relates to the orientation of the numbers as they appear on the individual faces of the individual cube pieces 12. As will be seen in FIGS. 3 and 4, the cube piece 12 illustrated has the numbers 2, 5, and 7 oriented in three different positions on the six faces of the cube piece 12. It will be appreciated that there are four possible orientations for each of the numbers corresponding to which of the four edges of the square face the number is oriented.

FIGS. 6A–AA illustrate the complete numbering, lettering, orientation and coloring of the 27 cubes in accordance with the preferred embodiment. It should be pointed out that the lettering appearing on each face of each cube piece 12 in this instance is used to identify the six different colors comprising the second identifying indicia or color indicia means. It will also be appreciated that the different colors which may be utilized can vary as may be desired. The only requirement is that each of the colors be distinguishable from one another. For example, the letter "A" in the preferred embodiment is used to designate the color orange, the letter "B" to designate the color red, the letter "C" to designate the color green, the letter "D" to designate the color blue, the letter "E" to designate the color black and the letter "F" to designate the color white. The alphabetic code or key letters A–AA comprising the third identifying indicia 18 for easily distinguishing one cube piece 12 from another do not appear on the faces in FIGS. 6A–AA, but instead appear as part of the figure designation. Under normal practice, such alphabetic code or key letters would appear on one or more faces of the cube pieces 12.

In accordance with the present invention, the particular numerical indicia means for the various cube pieces 12 are selected so as to provide a multitude of different cubic arrays 10 in which, on each of the six exposed surfaces of each different cubic array, the numerical indicia means on the nine assembled faces of the individual cube pieces 12 satisfy a predetermined arithmetic relationship between the numerical indicia means. Here it is to be noted that the use of numerical indicia means, e.g., arabic characters, or dots or other symbols whose quantity represents a number, permits the 27 individual cubes to be assembled into a cubic array 10 to provide a wide variety of puzzle solutions, each satisfying a predetermined arithmetic relationship. The possible solutions are varied in form or type (as well as in modifications of such different forms) to offer varying levels of challenge. Basically, it is the use of numerical indicia which are not subject to built-in prejudices in terms of proper ordering of the indicia (as otherwise exist with respect to letters) which permits a multitude of different solutions in which the numerical indicia means appearing on the assembled faces on the individual cube pieces 12 for each of the six exposed surfaces of the large cubic array 10 satisfy predetermined arithmetic relationships.

The particular sets of numerical indicia means illustrated in FIGS. 5 and 6 comprise one such set which will satisfy the above criteria of providing a plurality of solutions which is at least 10 in number. However, this is not meant to say that there are not other sets which likewise would provide a multitude of different solutions. Because of the great variety of types of arithmetic relationships which are possible, as well as the numerous variations of such relationships which exist, it is expected that a great number of different sets of six numerical identifying indicia for the different cubes are possible.

In this regard, the particular sets of six numerical indicia for the 27 cube pieces 12 illustrated in the figures was derived in the preferred embodiment by initially assemblying blank cubes, i.e., cubes having no indicia thereon, into the desired 27 piece cubic array 10 having a 3 by 3 by 3 configuration. A particular arithmetic relationship was then chosen and the individual exposed faces in the array 10 marked in accordance with the chosen arithmetic relationship. For example, the initial arithmetic relationship comprised an ascending arithmetic progression for the various faces of the large cube 10 in a horizontal pattern, i.e., the particular arrangement illustrated in FIGS. 1 and 2. Also, color indicia means were provided so that the exposed assembled nine faces comprising each of the exposed surfaces of the large cube 10 were of a single color, with the six different surfaces being of a different color. Thereafter, the cubic array 10 was disassembled and a different predetermined arithmetic relationship chosen (e.g., a descending progression in a horizontal pattern) and an attempt made to satisfy this relationship with those faces of the individual cube pieces 12 having numerical and color indicia thereon. To the extent that this was not possible, blank faces of the individual cube pieces 12 were placed in various positions, and numerical indicia and color indicia then provided thereon to complete the desired array. This procedure was repeated for different arithmetic solutions until every face of the individual cube pieces 12 was marked with numerical and color indicia. This occurred after approximately 17 different solutions, some of which involved both arithmetic and color relationships and some of which only involved either an arithmetic or color relationship.

Even after all of the faces had been completed, it was found that still further different arithmetic relationships, as well as color relationship, could be satisfied to provide still further solutions for the puzzle.

The complexity and difficulty of the various solutions is further enhanced by the addition of the color indicia and also the orientation variable. In this regard, it should also be noted that the particular solutions are not all of the same difficulty. Some are easier than others. For instance, any solution requiring that both an arithmetic and a color relationship to be satisfied is generally more difficult than if only one relationship has to be satisfied. Thus, the difficulty of the puzzle which is to be solved will depend on the number and type of indicia which will be used to provide a solution as well as the particular relationship which is chosen to be satisfied. Some puzzles may have many solutions, while others will have very few or a single solution.

The provision of 27 cube pieces having six faces and two sets of identifying indicia thereon, as well as four different variations or orientation of such indicia provide many trillions of possible cube configurations. While not all of these possible configurations will satisfy particular arithmetic and color relationships, a great many will, particularly since the number of arithmetic relationships possible is quite large. Examples of typical arithmetic relationships which can be satisfied with the puzzle of the present invention include progressions (ascending and descending), the sum of the faces of the cube pieces 12 exposed on each surface of the large cube being a particular number or form of number (such as a square or cube of a number or a prime number), odd and/or even patterns of numbers, or the assembled faces of the cube pieces 12 on a surface of the cube being the same. Still further relationships are also possible, as will be described more fully hereinbelow.

Thus, it will be appreciated that because of the wide variety or multitude of different puzzle solutions which are possible, even when one particular solution is achieved, there is still a multitude of remaining different solutions which are possible. Consequently, the puzzle in accordance with the present invention will provide endless challenge and interest to the puzzle solver. This feature of providing a multitude of different solutions is basically the result of the use of numerical indicia which, in any particular solution, are to satisfy different predetermined arithmetic relationships. In this regard, the numerical indicia should be selected for the various faces of the cube pieces 12 so as to satisfy preferably at least ten different arithmetic solutions or relationships for the surfaces of the larger cubic array 10.

Examples of possible solutions, including types of solutions, will now be given for the particular embodiment of numerical and color indicia illustrated in FIGS. 6A-AA.

One possible solution for the puzzle of the present invention is illustrated in FIGS. 1 and 2, in which all 27 cube pieces 12 are assembled in a larger cubic array 10 such that the numbers one through nine (first set of identifying indicia) are arranged in increasing and ascending order on each face of the assembled cube 10, and such that each surface of the cube 10 is of one color (the second set of identifying indicia) with no color duplication. In addition, there are no number duplications and the numbers on each surface of the assembled cube 10 are oriented in the same way. On a scale of 1–4 with 1 being the easiest and with 4 being the hardest or most difficult, the difficulty of this solution is 3.

The particular location of the various cube pieces 12 within the larger cubic array 10 for satisfying this particular solution is given in Table I which illustrates the particular cube pieces 12 and their location in the top layer of nine cubes of the larger cubic array 10, the middle layer of nine cubes and the bottom layer of nine cubes. From this information respecting the locations of the cube pieces, the particular orientations of the cube pieces at the particular locations can be determined relatively easily so as to provide the desired solution.

TABLE I

| TOP LAYER | MIDDLE LAYER | BOTTOM LAYER |
|---|---|---|
| J - E - Z | I - L - T | G - O - Y |
| AA - U - Q | W - S - N | D - X - M |
| K - F - C | H - A - B | V - P - R |

Another possible solution of the puzzle in which the larger cubic array 10 has one color per side with the numbers one through nine arranged in decreasing or descending order is given in Table II which illustrates the locations of the cube pieces 12 in the top, middle and bottom layers. The difficulty of this solution is also 3.

TABLE II

| TOP LAYER | MIDDLE LAYER | BOTTOM LAYER |
|---|---|---|
| S - V - Y | P - M - J | G - D - A |
| T - W - Z | Q - N - K | H - E - B |
| U - X - AA | R - O - L | I - F - C |

Another possible solution, which has a difficulty of 1, is one in which the cube pieces may be assembled such that there is only one color per side and in which the numbers may be used more than once with the orientation of the numbers being unimportant. In this instance, the numerical indicia means do not satisfy any particular arithmetic relationship. The location of the cube pieces 12 (which is one of many possible answers) for this solution is set forth in Table III.

TABLE III

| TOP LAYER | MIDDLE LAYER | BOTTOM LAYER |
|---|---|---|
| D - I - X | O - F - P | M - J - B |
| A - W - K | U - T - L | E - AA - V |
| N - G - H | S - Z - R | Y - Q - C |

Similarily, the cube pieces 12 could be assembled in such a way that the numbers are in increasing or decreasing orders, but the colors may be randomly situated with more than one color being permitted on one cube surface of the large cube 10. This solution would have a difficulty of 2. One particular array or arrangement of the cube pieces 12 for this solution is set forth in Table IV.

TABLE IV

| TOP LAYER | MIDDLE LAYER | BOTTOM LAYER |
|---|---|---|
| W - U - Z | Q - R - M | A - K - N |
| I - C - L | AA - Y - V | B - J - D |
| G - H - S | F - P - O | X - T - E |

A still further possible solution of the puzzle in accordance with the present invention is one in which each of the six surfaces of the finished cube has the sum of the exposed nine faces being equal to a particular number, such as for example 50. The colors and number orientation are unimportant in this solution, and the difficulty would be a 1. One particular arrangement of the cube pieces 12 for this solution is set forth in Table V.

TABLE V

| TOP LAYER | MIDDLE LAYER | BOTTOM LAYER |
|---|---|---|
| P - H - E | O - J - R | Z - G - AA |
| L - D - X | S - V - A | I - Q - F |
| K - U - M | N - Y - C | W - B - T |

A still further solution in which each surface of the cube is one color with the sum of the numbers shown thereon being equal to 50 (the orientation being unimportant) is set forth in Table VI. The difficulty of this solution is 3.

TABLE VI

| TOP LAYER | MIDDLE LAYER | BOTTOM LAYER |
|---|---|---|
| I - Y - O | H - L - R | S - M - Q |
| U - W - B | Z - C - J | P - T - E |
| X - D - G | K - N - F | A - V - AA |

A further variation or solution is one in which each surface of the cubic array 10 is one color and in which the sum of the nine exposed faces of the individual cubes on each surface of the cubic array 10 is a perfect square of some number, for example the number 7 with its square being 49. The orientation of the numbers is unimportant and the difficulty would be 3. The arrangement of the cube pieces 12 for the solution is set forth in Table VII.

TABLE VII

| TOP LAYER | MIDDLE LAYER | BOTTOM LAYER |
|---|---|---|
| C - T - M | U - E - Y | D - K - S |
| H - B - Q | X - O - A | J - I - G |
| V - L - AA | F - W - Z | R - N - P |

Another solution is one in which there is one color per side, with the orientation of the numbers being unimportant and the sum of the nine assembled faces being a prime number, such as for example 41. The difficulty of this solution would also be 3. One arrangement of the cube pieces 12 for this solution is set forth in Table VIII.

TABLE VIII

| TOP LAYER | MIDDLE LAYER | BOTTOM LAYER |
|---|---|---|
| T - O - C | W - D - G | V - A - K |
| Z - Y - P | B - L - N | R - U - AA |
| Q - J - E | H - S - F | I - M - X |

A still further variation is one in which the cube pieces 12 are assembled so that each side or surface of the cube array 10 is of one color, with the orientation being unimportant and the sum of each side being equal to the cube of some number. For example, the sum of the numbers on 3 surfaces of the cubic array 10 could be 27 (the cube of 3) while the sum of the numbers on the 3 remaining surfaces could be 64 (the cube of 4). One arrangement of the cube pieces 12 to satisfy this solution, in which the surfaces whose numerical indicia add to 27 with the opposite surface having the numerical indicia adding to 64 is set forth in Table IX. The difficulty of this solution is 4.

TABLE IX

| TOP LAYER | MIDDLE LAYER | BOTTOM LAYER |
|---|---|---|
| C - K - P | G - H - S | T - O - E |
| F - W - AA | M - A - Y | B - J - V |
| L - D - I | Q - U - X | Z - R - N |

Another example of a type of variation which can be solved is one in which the cube pieces are arranged so that each color covers three or four sides in a "C" formation in the large cubic array 10. Each row would be of one color, with numbers and their orientation being irrelevant. For example, three horizontal rows of the same three or four sides are each a different color and the three vertical columns are each of the last three remaining colors, different again, covering three of the four vertical sides, including the fourth and unused side of the horizontal rows. Each set of nine faces encircling three of the four sides are of a different color. When assembled, the cubic array would appear to comprise two interlocking C's. One arrangement to satisfy this solution is set forth in Table X. The difficulty would be 2.

TABLE X

| TOP LAYER | MIDDLE LAYER | BOTTOM LAYER |
|---|---|---|
| B - F - M | O - C - J | P - G - W |
| T - S - V | Q - L - H | N - R - U |
| Y - Z - X | E - D - AA | K - I - A |

Another puzzle solution is one in which the cube is arranged so that the numbers appear on each face in increasing order but vertical orientation. The number orientation and colors are unimportant. This solution would have a difficulty of 2. One arrangement satisfying this solution is set forth in Table XI.

TABLE XI

| TOP LAYER | MIDDLE LAYER | BOTTOM LAYER |
|---|---|---|
| Y - L - J | M - T - E | U - Q - A |
| D - C - B | X - I - AA | F - V - H |
| S - O - G | N - K - P | W - Z - R |

Another possible solution is one in which the cube is arranged so that the colors on one side have the first and third rows of the same color, with the second row being of the same color as the first and third rows on the opposite sides. The color of the second row on the opposite side is the same as the first and third on the one side. This is to be accomplished for all six sides. Again the numbers and their orientation is unimportant. One possible arrangement for this solution is set forth below in Table XII. The difficulty of this solution is 1.

TABLE XII

| TOP LAYER | MIDDLE LAYER | BOTTOM LAYER |
|---|---|---|
| S - D - J | K - O - N | G - Z - H |
| I - B - AA | P - L - U | R - W - E |
| X - M - Y | T - V - A | C - F - Q |

A still further solution is one in which the cube pieces 12 are arranged in such a manner that only one color appears in each side, with number order and their orientation being unimportant, but on each side the numbers that appear are all odd numbers with the exception that the very middle number is even. Thus, the perimeter of each side is made up of odd numbers and the center block shows the only even number on each side. The difficulty for this solution is a 3. One arrangement to satisfy this solution is set forth in Table XIII.

TABLE XIII

| TOP LAYER | MIDDLE LAYER | BOTTOM LAYER |
|---|---|---|
| U - M - Z | Q - B - I | N - X - Y |
| G - F - C | T - L - H | A - O - W |

TABLE XIII-continued

| TOP LAYER | MIDDLE LAYER | BOTTOM LAYER |
|---|---|---|
| K - J - S | P - D - R | V - E - AA |

Another variation is one in which the cube pieces 12 are arranged so that only one number appears on each face, with the number orientation and color not being important. Thus, all nine blocks in each face would have the same number. The difficulty of this solution would be a 3. One arrangement to satisfy this solution is set forth in Table XIV.

TABLE XIV

| TOP LAYER | MIDDLE LAYER | BOTTOM LAYER |
|---|---|---|
| E - A - V | J - P - X | Q - W - C |
| R - H - S | O - T - F | N - D - I |
| G - AA - Y | L - M - B | K - Z - U |

A still further solution with the puzzle of the present invention is one in which the cube pieces 12 are arranged so as to obtain the highest possible sum of the nine numbers shown on the nine blocks of each face of the cube. Two variations are possible in this arrangement. First, with no specific color being required, the object is to obtain the highest possible sum of the entire six sides. One arrangement to satisfy this solution (which has a difficulty of 3) is set forth in Table XVA.

TABLE XVA

| TOP LAYER | MIDDLE LAYER | BOTTOM LAYER |
|---|---|---|
| X - H - N | G - Z - D | P - K - O |
| T - W - I | B - L - U | Q - AA - M |
| E - J - V | Y - C - A | F - R - S |

The second variation is one in which there is one specific color per side or surface of the cubic array 10 with the colors not being duplicated on the six sides. The cube pieces 12 are arranged so as to obtain the highest sum on each side. One arrangement to satisfy this solution (which also has a difficulty of 3) is set forth in Table XVB.

TABLE XVB

| TOP LAYER | MIDDLE LAYER | BOTTOM LAYER |
|---|---|---|
| T - B - R | Q - U - AA | S - H - X |
| D - I - G | C - L - F | N - M - W |
| K - O - P | E - Z - J | Y - V - A |

A further solution is one in which the cube pieces 12 are arranged so that each face has the four corner and the center cube pieces 12 showing odd numbers and the other four pieces 12 showing even numbers. The particular colors and orientations are unimportant. The difficulty of this solution is 1. One typical arrangement for this solution is set forth as follows in Table XVI.

TABLE XVI

| TOP LAYER | MIDDLE LAYER | BOTTOM LAYER |
|---|---|---|
| G - F - A | W - J - D | Z - B - R |
| H - N - O | M - Q - S | P - C - L |
| I - T - U | K - X - AA | E - V - Y |

A still further solution is one in which the cube pieces 12 are arranged so that in each surface of the cubic array 10 an "X" is formed in one color and the other four cube pieces 12 show the color of the X on the opposite surface. The numbers and their orientation are unimportant. Also, the six surfaces in this arrangement would have a color arrangement which is opposite to that appearing on its opposite surface. The difficulty of this solution is 1. One arrangement for this solution is set forth as follows in Table XVII.

TABLE XVII

| TOP LAYER | MIDDLE LAYER | BOTTOM LAYER |
|---|---|---|
| Y - X - J | F - Z - O | A - G - N |
| R - P - D | C - E - W | I - K - U |
| V - L - Q | B - M - AA | S - T - H |

The above-note puzzle solutions in Tables I–XVII were utilized in determining or selecting the numerical and color indicia means (as well as the orientation of the numerical indicia means) for the various faces of the 27 individual cube pieces 12 which are shown in FIGS. 6A–AA. However, after all of the faces of the cube pieces 12 were provided with both numerical and color indicia, it was determined that still further solutions in which the numerical indicia means would satisfy predetetermined arithmetic relationships were still possible. Examples of five additional solutions and arrangements of cube pieces 12 to satisfy same are set forth below with reference to Tables XVIII–XXII.

For instance, the cube pieces 12 could be arranged so that the only odd numbers appear on each surface of the cubic array 10. The color and orientation of the numbers is unimportant, and the difficulty would be 3. One arrangement to satisfy this solution is set forth in Table XVIII.

TABLE XVIII

| TOP LAYER | MIDDLE LAYER | BOTTOM LAYER |
|---|---|---|
| U - M - Z | Q - B - I | N - X - Y |
| G - F - C | T - L - H | A - O - W |
| K - J - S | P - D - R | V - E - AA |

Another solution is one in which only even numbers appear about the perimeter of each surface with the center face of each surface being an odd number. Again, the color and orientation are unimportant. The difficulty would be 2. One arrangement of the cube pieces 12 for satisfying this solution is set forth in Table XIX.

TABLE XIX

| TOP LAYER | MIDDLE LAYER | BOTTOM LAYER |
|---|---|---|
| Q - R - D | E - Y - X | F - J - P |
| W - Z - K | A - B - C | U - G - V |
| O - L - T | I - S - AA | M - N - H |

A further solution is one in which the cube pieces 12 are arranged so that the third number in each row on each surface of the cubic array 10 equals the sum of the first two numbers in that row. Again, the color and orientation are unimportant. The difficulty of this solution is 1. A possible arrangement of cube pieces 12 to satisfy this solution is set forth in Table XX.

TABLE XX

| TOP LAYER | MIDDLE LAYER | BOTTOM LAYER |
|---|---|---|
| E - Q - D | AA - Z - G | C - T - P |
| M - O - A | R - H - Y | J - N - K |
| X - W - V | L - S - I | F - U - B |

A still further solution is one in which the sum of the numbers on each surface of the cubic array 10 is a multiple of a number such as 5. The sum may be duplicated on different surfaces of the cubic array 10. The color and orientation are unimportant and the difficulty of this solution would be 2. One arrangement for this solution is set forth in Table XXI.

TABLE XXI

| TOP LAYER | MIDDLE LAYER | BOTTOM LAYER |
|---|---|---|
| N - Y - L | B - U - E | V - X - M |
| I - A - S | AA - D - W | H - O - P |
| R - Q - Z | T - C - F | J - G - K |

Another solution is one on which the sum of the numbers on each surface of the cubic array 10 is a different multiple of some number, such as 10. For instance, the sum of the numbers on the six surfaces could be 10, 20, 30, 40, 50 and 60, respectively. Color and orientation are unimportant. The difficulty would be 3. One arrangement to satisfy this solution is set forth in Table XXII.

TABLE XXII

| TOP LAYER | MIDDLE LAYER | BOTTOM LAYER |
|---|---|---|
| E - H - M | L - AA - R | K - J - N |
| Z - O - V | G - P - Y | W - F - A |
| Q - D - I | T - B - S | X - C - U |

The above examples of additional solutions is not meant to be limiting. There are many more possible solutions in which the numerical indicia means will satisfy predetermined arithmetic relationships. As has been noted above, this feature of having a multitude of solutions is achieved as a result of using numerical indicia on each face of the 27 individual cube pieces 12, the indicia being selected so at to satisfy particular arithmetic relationships.

Furthermore, while the puzzle in accordance with the preferred embodiment and which has been illustrated above is comprised of 27 individual cubes 12 which are arranged into a larger cube 10, it will also be appreciated the principles employed may also be utilized with respect to large cubes 10 made up of different numbers of individual blocks, such as for example eight and sixty-four or some other cubic number. In these cases, the sets of numerical identifying indicia would reflect such change. For example, an eight piece cube puzzle would have the numbers one through four thereon, and would be arranged in a 2 by 2 by 2 configuration with the six colors still applying. For a sixty-four piece cube puzzle, the numbers would be one through sixteen, and the configuration of the cube would be 4 by 4 by 4. Again, the six colors would apply.

It will thus be appreciated that in accordance with the present invention there is provided a three dimensional cube puzzle which is comprised of a group of individual cube pieces 12 each having six exposed faces, the number of cube pieces 12 being a cubic number. Numerical indicia means are provided on each face of each of the cube pieces 12, the numerical indicia means being representative of a number selected from a group of $n^2$ different numbers in which n is an integer greater than one. The number of individual cube pieces 12 in the group is $n^3$. Eace face of each of the cube pieces 12 has one of the numerical indicia means thereon to define a set of six numerical indicia for each cube piece 12, substantially all of the sets of six numerical indicia being different and consisting of from two to six different numbers. Support means 14 for holding and displaying a cubic array 10 of the n cube pieces 12 assembled to provide an n by n by n configuration is also provided. The cubic array 10 has six exposed surfaces each of which is comprised of $n^2$ assembled faces of the cube pieces 12 in an n by n configuration. The support means 14 is adapted to maintain the assembled cube pieces 12 in the cubic array 10 and to permit visual inspection of each of the six exposed surfaces of the cubic array 10. The numerical indicia means for the cube pieces 12 is selected to provide at least 10 different cubic arrays 10 in which, on each of the six exposed surfaces of each such cubic array, the numerical indicia means on the $n^2$ assembled faces of the individual cube pieces 12 satisfy a predetermined arithmetic relationship between the numerical indicia means. Also in accordance with the preferred embodiment, color indicia means are provided on each face of the cube pieces 12, and the color indicia means and numerical indicia means are selected so as to satisfy predetermined arithmetic and color relationships in various solutions.

While the preferred embodiment of the present invention has been shown and described, it will be understood that such is merely illustrative and that changes may be made without departing from the scope of the invention as claimed.

What is claimed is:

1. A three dimensional cube puzzle comprising:

27 individual cube pieces each having six exposed faces;

numerical indicia means on each face of each of said 27 cube pieces, said numerical indicia means being representative of a number selected from a group of nine different numbers, each face of each of said cube pieces having one of said numerical indicia means thereon to define a set of six numerical indicia for each cube piece, and substantially all of said sets of six numerical indicia being different and consisting of from two to six different numbers;

support means for holding and displaying a cubic array of said 27 cube pieces assembled to provide a 3 by 3 by 3 configuration, said cubic array having six exposed surfaces each of which is comprised of nine assembled faces of said cube pieces in a $3\times3$ configuration, said support means being adapted to maintain said 27 assembled cube pieces in said cubic array and to permit visual inspection of each of said six exposed surfaces of said cubic array; and said numerical indicia means for said cube pieces being selected to provide at least 10 different cubic arrays in which, on each of said six exposed surfaces of each such cubic array, said numerical indicia means on said nine assembled faces of said individual cube pieces satisfy a predetermined arithmetic relationship between said numerical indicia means.

2. The cube puzzle of claim 1, further including color indicia means for each face of each of said 27 cube pieces, said color indicia means being representative of a color selected from a group of six different distinguishable colors, each of said cube piece faces having one of said color indicia means thereon to define a set of six color indicia for each cube piece, and substantially all of said sets of six color indicia consisting of from two to five different colors; and said color indicia means for said cube pieces being selected to provide a plurality of different cubic arrays in which, on each of said six exposed surfaces of said plurality of cubic arrays, said numerical indicia means and said color indicia means on said nine assembled faces of said individual cube pieces satisfy a predetermined arithmetic and color relationship between said numerical and color indicia means.

3. The cube puzzle of claim 2 wherein said numerical indicia means have from one to four different orientations on said six faces of each of said 27 cube pieces, and wherein the orientation of said numerical indicia means is selected to provide a plurality of different cubic arrays in which, on each of said six exposed surfaces of said plurality of cubic arrays, said numerical indicia means and color indicia means on said nine assembled faces of such individual cube pieces satisfy a predetermined arithmetic, color and orientation relationship between said numerical and color indicia means.

4. The cube puzzle of claim 3 wherein said numerical indicia means is representative of a number from one to nine.

5. The cube puzzle of claim 4 wherein said numerical indicia means comprise arabic numerals.

6. The cube puzzle of claim 5 wherein said arabic numerals are provided on each face of said cube pieces in one of said six different distinguishable colors.

7. The cube puzzle of claim 2 wherein said numerical indicia means comprise arabic numerals.

8. The cube puzzle of claim 7 wherein said arabic numerals are provided on each face of said cube pieces in one of said six different distinguishable colors.

9. The cube puzzle of claim 1 wherein said numerical indicia means is representative of a number from one to nine.

10. The cube puzzle of claim 9 wherein said numerical indicia means comprise arabic numerals.

11. The cube puzzle of claim 1 wherein said support means comprises a transparent cube-shaped case having at least one openable side, said transparent case being of a size approximating the size of said cubic array of 27 individual cube pieces.

12. A three dimensional cube puzzle comprising:

$n^3$ individual cube pieces each having six exposed faces, n being an integer greater than 1;

numerical indicia means on each face of each of said $n^3$ cube pieces, said numerical indicia means being representative of a number selected from a group of $n^2$ different numbers, each face of each of said cube pieces having one of said numerical indicia means thereon to define a set of six numerical indicia for each cube piece, and substantially all of said sets of six numerical indicia being different and consisting of from two to six different numbers;

support means for holding and displaying a cubic array of said $n^3$ cube pieces assembled to provide an n by n by n configuration, said cubic array having six exposed surfaces each of which is comprised of $n^2$ assembled faces of said cube pieces in an n by n configuration, said support means being adapted to maintain said $n^3$ assembled cube pieces in said cubic array and to permit visual inspection of each of said six exposed surfaces of said cubic array; and said numerical indicia means for said cube pieces being selected to provide at least 10 different cubic arrays in which, on each of said six exposed surfaces of each such cubic array, said numerical indicia means on said $n^2$ assembled faces of said individual cube pieces satisfy a predetermined arithmetic relationship between said numerical indicia means.

13. The cube puzzle of claim 12, further including color indicia means for each face of each of said $n^3$ cube pieces, said color indicia means being representative of a color selected from a group of six different distinguishable colors, each of said cube piece faces having one of said color indicia means thereon to define a set of six color indicia for each cube piece, and substantially all of said sets of six color indicia consisting of from two to five different colors; and said color indicia means for said cube pieces being selected to provide a plurality of different cubic arrays in which, on each of said six exposed surfaces of said plurality of cubic arrays, said numerical indicia means and said color indicia means on said $n^2$ assembled faces of said individual cube pieces satisfy a predetermined arithmetic and color relationship between said numerical and color indicia means.

14. The cube puzzle of claim 13 wherein said numerical indicia means have from one to four different orientations on said six faces of each of said $n^3$ cube pieces, and wherein the orientation of said numerical indicia means is selected to provide a plurality of different cubic arrays in which, on each of said six exposed surfaces of said plurality of cubic arrays, said numerical indicia means and color indicia means on said $n^2$ assembled faces of such individual cube pieces satisfy a predetermined arithmetic, color and orientation relationship between said numerical and color indicia means.

15. The cube puzzle of claim 14 wherein said numerical indicia means is representative of a number from one to $n^2$.

16. The cube puzzle of claim 15 wherein said numerical indicia means comprise arabic numerals.

17. The cube puzzle of claim 13 wherein said support means comprises a transparent cube-shaped case having at least one openable side, said transparent case being of a size approximating the size of said cubic array of $n^3$ individual cube pieces.

18. The cube puzzle of claim 12 wherein n is an integer greater than 2.

* * * * *

UNITED STATES PATENT AND TRADEMARK OFFICE

CERTIFICATE OF CORRECTION

PATENT NO. : 4,494,756

DATED : January 22, 1985

INVENTOR(S) : Gordon E. Winer

It is certified that error appears in the above-identified patent and that said Letters Patent are hereby corrected as shown below:

Column 3, Line 48, "this" should read --the--.
Column 3, Line 54, "sufficient" should read --different--.
Column 6, Line 16, "oder" should read --order--.
Column 9, Line 67, "relationship" should read --relationships--.
Column 13, Line 3, "or" should read --of--.
Column 13, Line 7, "or" should read --of--.

Signed and Sealed this

*Seventh* Day of *May 1985*

[SEAL]

*Attest:*

DONALD J. QUIGG

*Attesting Officer* *Acting Commissioner of Patents and Trademarks*